United States Patent [19]

Smith et al.

[11] Patent Number: 4,819,566

[45] Date of Patent: Apr. 11, 1989

[54] STABILIZED STEERABLE TRUCK

[75] Inventors: Roy E. Smith; Ron J. Anderson, both of Kingston, Canada

[73] Assignee: Urban Transportation Development Corp., Ltd., Canada

[21] Appl. No.: 63,774

[22] Filed: Jun. 24, 1987

Related U.S. Application Data

[63] Continuation of Ser. No. 765,088, Aug. 13, 1985, abandoned.

[51] Int. Cl.[4] ..... B61F 5/44

[52] U.S. Cl. ..... 105/168; 105/199.4; 105/3

[58] Field of Search ..... 105/157.1, 182.1, 199.1, 105/199.2, 199.4

[56] References Cited

U.S. PATENT DOCUMENTS

| | | | |
|---|---|---|---|
| 243,797 | 7/1881 | Robinson | 105/168 |
| 356,347 | 1/1887 | Brown et al. | 105/168 |
| 553,268 | 1/1896 | Skov | 105/165 |
| 1,388,508 | 8/1921 | Brilhart | 105/168 X |
| 2,071,207 | 2/1937 | Knecht | 105/165 |
| 3,789,770 | 2/1974 | List | 105/168 |
| 4,095,531 | 6/1978 | Bennett | 105/168 X |
| 4,170,179 | 10/1979 | Vogel | 105/168 |
| 4,327,649 | 5/1982 | Kreissig | 105/182 R X |
| 4,455,946 | 6/1984 | List | 105/168 |

FOREIGN PATENT DOCUMENTS

| | | | |
|---|---|---|---|
| 1146907 | 4/1963 | Fed. Rep. of Germany | 105/199 R |
| 1210026 | 2/1966 | Fed. Rep. of Germany | 105/199 R |
| 0893949 | 11/1944 | France | 105/165 |
| 6200 | of 1885 | United Kingdom | 105/165 |
| 1116012 | 6/1968 | United Kingdom | 105/199 R |

OTHER PUBLICATIONS

Forced Steering of Rail Vehicles: Stability and Curving Mechanics Vehicle System Dynamics 10, (1981), pp. 357–386, Bell & Hardwick.

*Primary Examiner*—Robert B. Reeves
*Assistant Examiner*—Scott H. Werny
*Attorney, Agent, or Firm*—Finnegan, Henderson, Farabow, Garrett & Dunner

[57] ABSTRACT

A railroad vehicle is provided for movement on rails. The vehicle has a car body and two trucks. Each of the trucks has an outboard and an inboard axle mounted to the truck for pivotal movement about respective vertical axes such that the axles may be moved to a radial position when the vehicle is travelling on curved track. Each of the trucks has a pivotal connection, offset from center toward the outboard axle, between the truck and the car body. Each of the trucks contains a steering mechanism whereby the axles are moved to the radial position when the vehicle is travelling on curved track, with the alignment being obtained in response to the angle through which the truck swivels relative to the car body in traversing the curved track. The steerable trucks are stable provided that certain mathematical relationships set out are satisfied.

4 Claims, 3 Drawing Sheets

STABILIZED STEERABLE TRUCK

This application is a continuation of application Ser. No. 765,088, filed Aug. 13, 1985, now abandoned.

FIELD OF THE INVENTION

This invention relates to railroad vehicles having trucks which are equipped with steerable axles.

BACKGROUND OF THE INVENTION

Various systems have been proposed in which a railroad truck comprises a pair of wheelsets with each of the wheelsets being attached to the truck in a manner that allows the wheelsets to move to a radial configuration when the truck is travelling on curved railroad tracks. One such example is Canadian Pat. No. 1,083,886 issued Aug. 19, 1980, to Urban Transportation Development Corporation Limited. Other examples include U.S. Pat. No. 2,071,207 to Heinrich Knecht (1935) and U.S. Pat. No. 356,347 to Brown and Midelton issued 1887.

In the foregoing patents and indeed in most systems providing a two axle truck having steerable axles the axles are mounted to the truck so as to be pivotal about a substantially vertical pivotal axis. When the truck enters a curve, the axles pivot about their respective pivotal axes so as to be radially aligned. Radial alignment is desirable for many reasons including reduction of wear of components and noise which would otherwise be caused by slippage of the wheels along the rail. It is convenient to refer to a truck having steerable axles as a steerable truck.

Although several mechanisms have been provided to permit radial alignment of axles very little thought has been given to preventing divergent behaviour of these axles when the truck is travelling along the track. By reason of minor variations in the rails or other problems there may be slight disturbances which would tend to turn the truck from its desired position. Analysis must be carried out to determine whether the truck will return to its desired position, once deviated from it, or whether it will continue to deviate further from the desired position until there is contact between the flange of the usual railroad wheel and the rail.

In most mechanisms including that illustrated in the aforesaid Canadian patent, the truck is attached to the railroad vehicle body for relative pivotal movement about a substantially vertical pivotal axis. In the ordinary case, where it is desired that the axles share the load equally, and the pivotal connection between the truck and the car body also carries the load of the car to the truck, the pivotal connection is located centrally between the axles. In some situations where the designers did not intend the wheels to share equal loads (such as when only one axle is driven) the pivotal axis is offset from the point midway between the axles.

We have found that steerable trucks are not necessarily stable. That is, when such steerable trucks are disturbed from the desired position they may not return to the desired position but rather continue to deviate until there is contact between the rail and flange of the wheel. We have found that it is possible to stabilize such a steerable truck by offsetting the pivotal axis between the truck and the railroad vehicle body by a certain critical amount. Alternatively, stability may be achieved in such a truck by providing resilient spring-like forces to restrain pivotal movement of the truck with respect to the car body alone or in combination with offset of the pivotal axis. We have discovered that there is an important mathematical relationship between the conicity of the wheels of the standard railroad vehicle forming part of the typical wheelset, the amount of offset of the pivotal axis from the midway point between the two axles of such a truck, and the resilience of the pivotal connection between the truck and the car body of the vehicle.

SUMMARY OF THE INVENTION

According to this invention a railroad vehicle is provided for movement on rails. The vehicle has at least one body portion and at least one truck. The truck has an outboard and an inboard axle relative to said body portion. The axles are mounted to said truck for pivotal movement about respective vertical axes such that said axles may be moved to a radial position when said vehicle is travelling on curved track. Each of said axles is adapted to support wheels of a wheelset, each wheelset having a conicity $\lambda$. The truck has a pivotal connection between the truck and said body portion. The truck has steering means whereby the axles are moved to the radial position when said vehicle is travelling on curved track, the alignment being obtained in response to the angle through which the truck pivots relative to said body portion in traversing the curved track. The ratio of said angle and the resultant angle through which each axle pivots relative to the truck defines a steering ratio for the steering means, which ratio is common for the two axles of said truck.

The railroad vehicle comprises stabilizing means to inhibit deviation of the truck from the desired position relative to the rails. The stabilizing means has (a) a resilient element in said pivotal connection between said truck and said body portion, said element having a torsional stiffness $K_T$ and (b) said pivotal connection between said truck and said body portion is offset a distance $\chi$ from a point midway between said axles wherein $K_T$, $\lambda$, and $|\chi|$ may each be zero or larger and $K_T$, $\lambda$, and $\chi$ are selected such that said truck acting under the usual forces generated by pivotally affixed wheelsets having said conicity $\lambda$ develops restoring forces under deviation from said desired position tending to restore the truck to said desired position.

BRIEF DESCRIPTION OF THE DRAWINGS

The invention will now be discussed in greater detail in association with the following drawings which illustrate schematically a railroad vehicle having trucks according to a preferred embodiment of the invention.

DETAILED DESCRIPTION OF THE PREFERRED EMBODIMENTS

Figure 1:
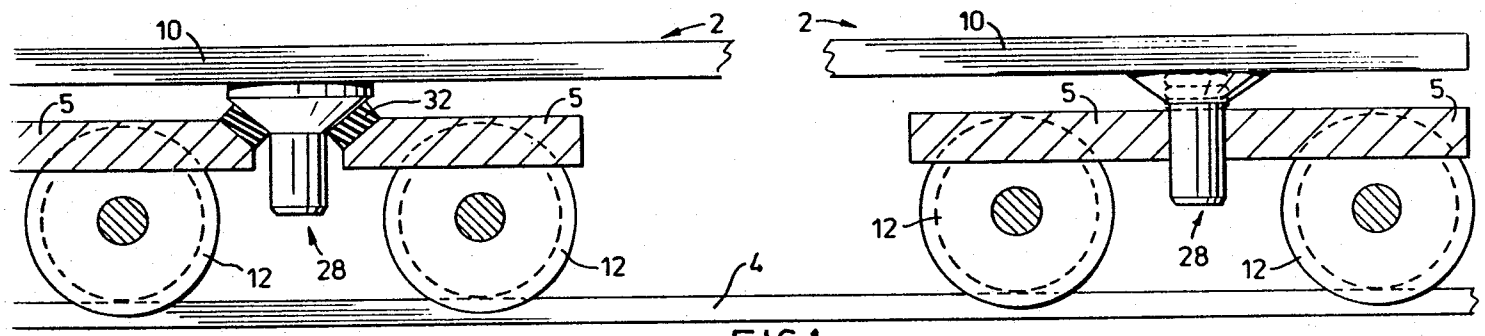
FIG. 1 is a schematic view of a railroad vehicle having two trucks according to the invention.

FIG. 1 illustrates a railroad vehicle 2 for travelling on railroad rails 4. Vehicle 2 comprises two trucks 5 supporting a body portion or car body 10. Each truck 5 comprises a pair of wheelsets having wheels 12. Each wheel 12 has a flange and conical running surface as typically used in railroad wheelsets. The conicity of the wheelset, being an average of the conicity of the two wheels 12, is denoted by $\lambda$. $\lambda=0$ is used to include the case of zero conicity when each wheel 12 outside of the flange thereof is essentially cylindrically shaped.

Figure 2:
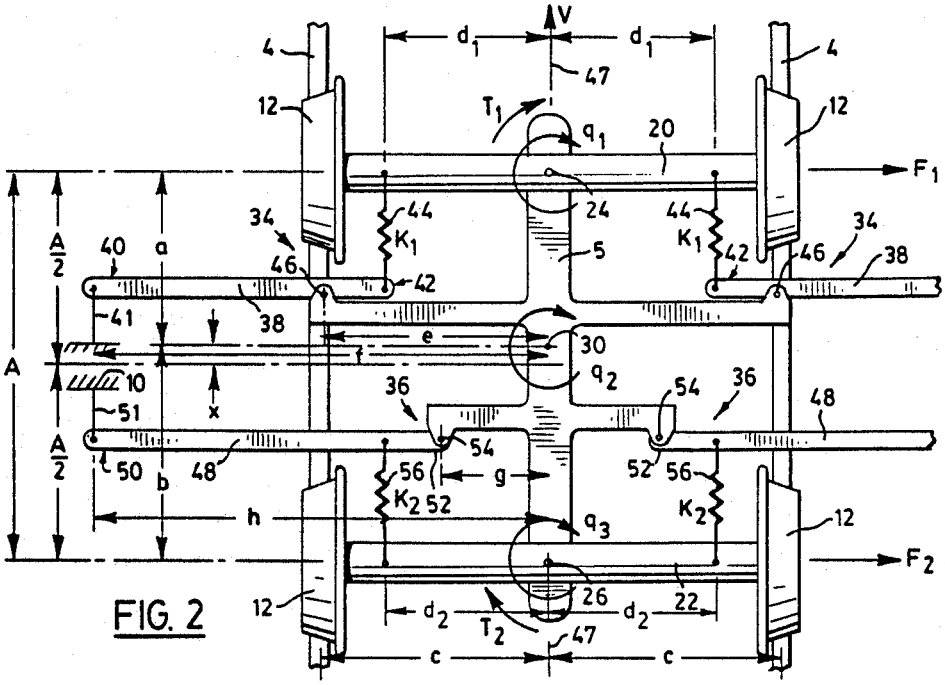
FIG. 2 illustrates schematically in plan, the forces and moments acting on a steerable truck in which may be provided an elastomeric restraint or torsional spring between the truck and vehicle body.

In order to appreciate the forces which develop on a steered truck, reference is made to FIGS. 2 to 5. FIG. 2 illustrates the forces and moments on a steered truck 5. Truck 5, depicted here as a leading truck, has outboard and inboard axles 20, 22 respectively. Axles 20, 22 are mounted to truck 5 for pivotal movement about respective vertical axes 24, 26 such that axles 20, 22 can be moved to a radial position when vehicle 2 is travelling on curved track. The truck 5 is provided with a pivotal connection 28 shown in FIGS. 1, 6 and 7 between truck 5 and car body 10, for pivotal movement about a vertical axis 30.

Figure 6:
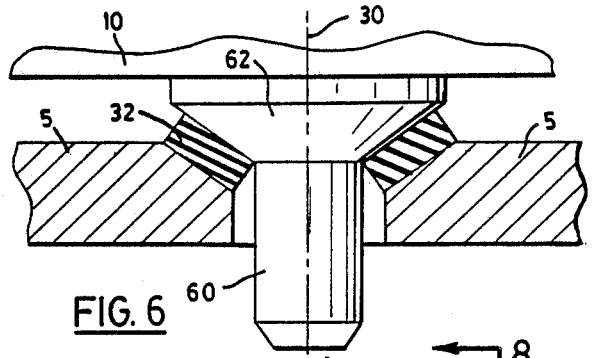
FIG. 6 illustrates a means of arranging for an elastomeric restraint between the car body and the truck frame.

The vertical axis 30 is not necessarily located at a point midway between axles 20, 22. In FIG. 2, axis 30 is offset a positive distance x in the direction toward outboard axle 20 from the geometric truck centre. However it is assumed throughout that axis 30 remains at the centre of rails 4. As illustrated in FIG. 6 and in FIGS. 7 and 8, the pivotal connection 28 is preferably provided with an elastomeric restraint or torsional spring (used here to include a suspension element with torsional stiffness, such as an air bag suspension). The elastomeric restraint, shown as 32 in FIG. 6 or alternatively the air bag suspension shown as 33 in FIGS. 7 and 8, produces a torsional stiffness, denoted by $K_T$, of pivotal connection 28. The torsional stiffness $K_T$ is greater than or equal to zero, $K_T=0$ being used to include the case of no elastomeric restraint or torsional spring provided in pivotal connection 28.

Truck 5 contains outboard and inboard steering means or mechanisms of a known kind, 35, 36 respectively, for moving respective axles 20, 22 to the radial position when the vehicle is travelling on curved track. This alignment of axles 20, 22 in the radial position is obtained in response to the angle through which truck 5 pivots about axis 30, relative to car body 10, in traversing the curve. The angle through which axle 20 or 22 pivots relative to truck 5 in attaining this alignment, is called the axle angle. The angle through which truck 5 pivots relative to car body 10 is called the body angle. The ratio of the body angle to the axle angle, denoted by k, is a characteristic of the steering means, known as the steering ratio.

As shown in FIG. 2 outboard steering means 34 comprise left and right steering levers 38, each having outer end portion 40 connected by connector 41 to car body 10 at a lateral distance f from vertical axis 30. Inner end portions 42 of levers 38 are connected by connectors 44 to axle 20 at a lateral distance $d_1$ on each side of the centre of axle 20. Between respective end portions 40, 42, steering levers 38 are pivotally connected to truck 5 for movement about axes 46, at a lateral distance e on each side of central axis 47—47 of truck 5.

Inboard steering means 36 comprise left and right steering levers 48, each having outer end portions 50 connected by connector 51 to car body 10 at a lateral distance h from vertical axis 30. Inner end portions 52 of levers 48 are pivotally connected to truck 5 for movement about axes 54, at a lateral distance g on each side of central axis 47—47 of truck 5. Between respective end portions 50, 52, steering levers 48 are connected by connectors 56 to axle 22 at a lateral distance $d_2$ on each side of the centre of axle 22.

Connectors 44 and 56, respectively connecting steering means 34, 36 to respective axles 20, 22 are each provided with a spring element, the spring elements having respective stiffnesses denoted by $K_1$ and $K_2$. It is well known to those skilled in the art that the stiffnesses of all of the components of the steering means for each axle may be represented by the single stiffness $K_1$ or $K_2$ as the case may be.

Figure 3:
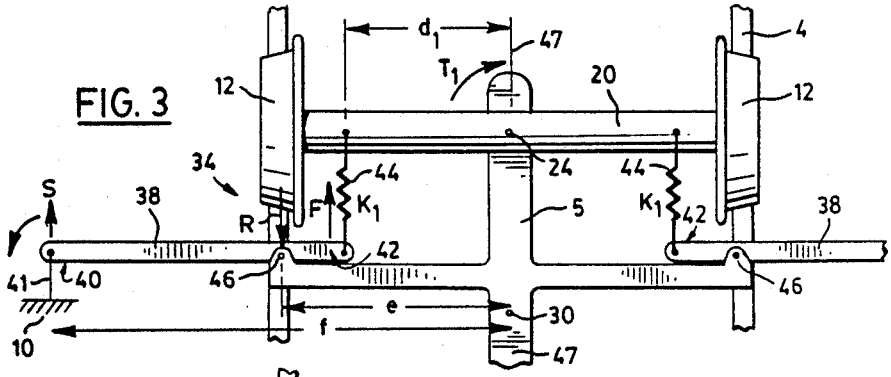
FIG. 3 is an enlarged view of a portion of FIG. 2 showing a steering lever and connections in close up.
Figure 4:
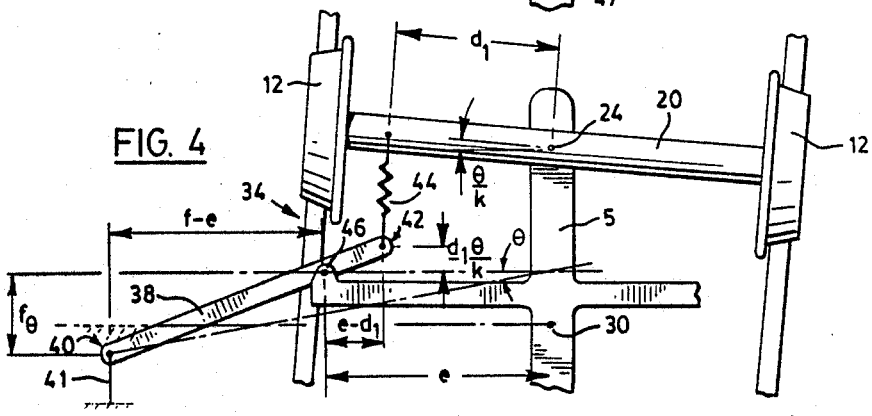
FIG. 4 is a view similar to FIG. 3 illustrating the functioning of the steering lever in aligning an axle on traversing a curve.

The choice of distances f, h from axis 30 to the connection at car body 10 of connectors 41, 51 respectively, determines the value k of the steering ratio for each axle. In order to appreciate how the value of f is selected for given values of k, $d_1$ and e, reference is now made to FIGS. 3 and 4. FIG. 3 depicts one steering lever 38 (on the left side of FIG. 2) connected to axle 20 and car body 10 and pivotally connected to truck 5 about axis 46.

The desired operation of steering means 34 in aligning outboard axle 20 to a radial position is first described. As a result of railroad vehicle 2 travelling on curved track, car body 10 swivels with respect to truck 5 about vertical axis 30. If railroad vehicle 2 is travelling around a clockwise curve, car body 10 will swivel counterclockwise, relative to (leading) truck 5, about vertical axis 30. Connectors 41 will then exert a force on levers 38 tending to cause them to pivot counterclockwise about axes 46, as illustrated for the left lever 38 in FIG. 4. Levers 38 will then apply cooperating forces through connectors 44 to axle 20. The result is to force axle 20 to pivot clockwise about vertical axis 24 into a radial position with respect to the clockwise curve. Steering means 36 similarly functions to align axle 22 in the radial position.

Suppose that car body 10 rotates about axis 30 an angle $\theta$ counterclockwise relative to truck 5. Since connector 41 is attached to car body 10 at a lateral distance f from axis 30, (left) connector 41 will be displaced a distance approximately $f.\theta$ inboard. Therefore, outer end portion 40 of (left) lever 38 will also be displaced inboard approximately a distance $f.\theta$. Since the steering ratio of steering means 34 is k, axle 20 will swivel an angle $\theta/k$ clockwise relative to truck 5. Connector 44 attaches to axle 20 at a lateral distance $d_1$ from the centre of axle 20. Therefore (left) connector 44 will be displaced outboard a distance approximately $d_1.\theta/k$. Hence inner end portion 42 will also be displaced outboard a distance approximately $d_1.\theta/k$. Therefore, from FIG. 4, to a good approximation, $$\frac{f \cdot \theta}{f - e} = \frac{\frac{d_1 \cdot \theta}{k}}{e - d_1}$$

or $$f = \frac{d_1 e}{(d_1 - e)k + d_1}$$

Therefore, $$f - d_1 = \frac{d_1 e - d_1(d_1 - e)k - d_1^2}{(d_1 - e)k + d_1} \quad (1)$$

$$f - e = \frac{(e - d_1)ke}{(d_1 - e)k + d_1} \quad (2)$$

However, in normal operation there will be disturbances acting on the truck. In what follows, reference is again made to FIG. 3. Suppose that a torque or moment $T_1$ exists acting on axle 20 about vertical axis 24. (Moments in the clockwise direction are positive.) This will result in a force F applied to each lever 38 at a lateral distance $d_1$ from central axis 47–47 of truck 5. Levers 39 will thus attempt to pivot about axes 46, resulting in forces S being applied to levers 38 by car body 10 through connectors 41. The forces S are applied at a lateral distance f from central axis 47—47 of truck 5.

Since axis 46 is located at a lateral distance e from central axis 47—47 of truck 5, taking moments about axis 46 yields $$S(f-e)=F(e-d_1)$$

or $$S=F(e-d_1)/(f-e)$$

The forces S and F on lever 38 are opposed by a force R at the fulcrum at axis 46. Therefore, $$R = F + S = F\left(1 + \frac{e - d_1}{f - e}\right)$$

Both left and right steering levers 38 each in turn apply a force of amount F through a connector 44 on axle 20, in opposition to the moment $T_1$, so that $$2Fd_1=T_1$$

Similarly, the moment on truck 5 due to levers 38 is $$\begin{aligned} M_1 &= 2 \cdot R \cdot e \\ &= 2 \cdot F\left(1 + \frac{e - d_1}{f - e}\right)e \\ &= \frac{e}{d_1} \cdot \frac{f - d_1}{f - e} \times 2Fd_1 \\ &= \frac{e}{d_1} \cdot \frac{f - d_1}{f - e} \cdot T_1 \end{aligned}$$

Therefore by equations (1) and (2)

$$\begin{aligned} M_1 &= \frac{e}{d_1} \cdot \frac{d_1 e - d_1(d - e)k - d_1^2}{(e - d_1)ke} T_1 \\ &= \left(1 + \frac{1}{k}\right)T_1 \end{aligned} \quad (3)$$

$M_1$ is the moment on leading truck 5 due to a moment $T_1$ on leading axle 20.

Similarly, the moment on leading truck 5 due to a torque or moment $T_2$ on trailing axle 22 is $$M_2=(1-1/k)T_2 \quad (4)$$

The results given in equations (3) and (4) have been derived for a mechanism involving horizontal levers. It can be shown that the same relationship exists in any mechanism with a steering ratio of k between the body angle and the axle angle regardless of the actual geometry chosen for the mechanism.

Reference is now made to FIG. 2 in order to derive an expression for the net moment on truck 5. Suppose again that there exists a moment $T_1$ on axle 20 and a moment $T_2$ on axle 22. Consequently axle 20 will pivot an angle $q_1$, and axle 22 an angle $q_3$, relative to car body 10. This will result in creep forces $F_1$ acting on truck 5 along axle 20, and $F_2$ acting on truck 5 along axle 22, in the direction shown in FIG. 2. Similarly creep torques will act on axles 20 and 22. Such creep forces have been studied in papers by F. W. Carter, "On the Action of a Locomotive Driving Wheel" (Proc. Royal Soc. London, Series A, Vol. 112, 1926, 151–157) and J. J. Kalker, "On the Rolling Contact of Two Elastic Bodies in the Presence of Dry Friction" (Doctoral Dissertation, Technische Hogeschool, Delft, Netherlands, 1967). Further study has been done by D. E. Newland, in the paper "Steering a Flexible Railway Truck on Curved Track", ASME Paper No. 69-RR-5, read at Joint Railroad Conference, Montreal, Quebec, 1969). He shows that $$F_1 = 2f_L\left(q_1 - \frac{q_2\, a}{v}\right) \quad (5)$$

$$F_2 = 2f_L\left(q_3 + \frac{q_2\, b}{v}\right) \quad (6)$$

$$T_1 = -2f_T c\left(\frac{\lambda a}{r_1} \cdot q_2 + \frac{q_1\, c}{v}\right) \quad (7)$$

$$T_2 = 2f_T c\left(\frac{\lambda b}{r_2} \cdot q_2 - \frac{q_3\, c}{v}\right) \quad (8)$$

Here, $f_L$ is the lateral creep coefficient, $f_T$ is the longitudinal creep coefficient, $q_2$ is the angular displacement of truck 5 relative to car body 10, a is the distance between vertical axes 24, 30, b is the distance between vertical axes 26, 30, c is one-half the rail gauge, λ is the wheelset conicity, $r_1$ is the wheel radius for the outboard axle, $r_2$ is the wheel radius for the inboard axle, and V is the velocity of the railroad vehicle 2.

In the steady state, equations (5)-(8) become:

$$F_1 = 2f_L\, q_1 \tag{9}$$

$$F_2 = 2f_L\, q_3 \tag{10}$$

$$T_1 = -2f_T\, c\, \frac{\lambda a}{r_1}\, q_2 \tag{11}$$

$$T_2 = 2f_T\, c\, \frac{\lambda b}{r_2}\, q_2 \tag{12}$$

Since steering means 34, 36 each have steering ratio k, $$q_1 = q_2(1+1/k)+\Delta q_1 \tag{13}$$

$$q_3 = q_2(1+1/k)+\Delta q_3 \tag{14}$$

where $\Delta q_1$ and $\Delta q_3$ are additional axle angular movements due to the stiffnesses $K_1$ and $K_2$ of the spring elements in connectors 44, 56 respectively or their equivalence in any other steering means. The relationship between $\Delta q_1$ and $T_1$, and between $\Delta q_3$ and $T_2$, is now derived.

FIG. 2 illustrates steering means which is symmetric about the longitudinal central axis 47—47 of the truck. If the steering means is not symmetric an equivalence relationship can be derived to equate it to the symmetric case. Let the stiffness of the steering means be $K_L$ and the distance of its point of application from the axle centre be $d_L$ for the left hand side of the steering means and let the corresponding quantities be $K_R$ and $d_R$ for the right hand side. The torque required to produce a displacement $\theta$ will be given by $T=K_L d_L^2\theta+K_R d_R^2\theta$; for the symmetric case the corresponding torque is given by $T=2K_1 d_1^2\theta$ from which it can be seen that $$K_1\, d_1^2 = \frac{K_L d_L^2 + K_R d_R^2}{2}$$

Clearly this can be extended to include more than one attachment per side. Because this direct equivalence relationship exists it is valid to treat all steering means as if they were symmetric, using equivalent values for K and d as derived above. All further analyses recorded herein include only the symmetric case on the understanding that the unsymmetric case can be substituted as above.

Figure 5:
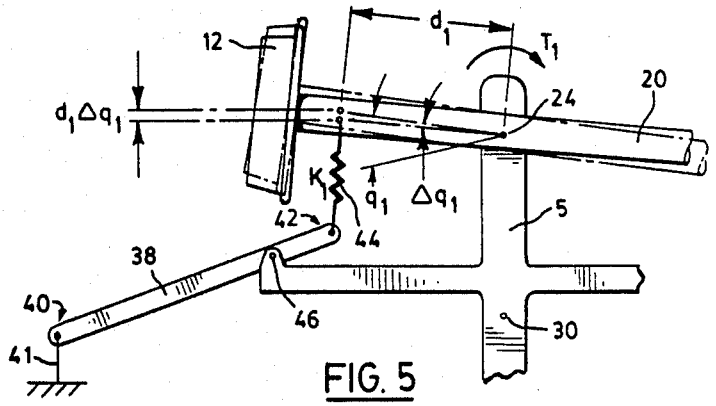
FIG. 5 is a view similar to that of FIG. 4 illustrating the additional angular displacement of an axle resulting from spring element connections between the steering means and the axle.

From FIG. 5 it is seen that if a torque $T_1$ acts on axle 20 causing it to rotate an additional angular amount $\Delta q_1$ (illustrated in dotted outline) this will result in a change of length $d_1.\Delta q_1$ in each connector 44. The resulting force then exerted by each connector 44 is $K_1 d_1.\Delta q_1$. Since this force is exerted on each side of axle 20 (in opposite directions) at a distance $d_1$ from vertical axis 24, the resulting moment is $2K_1 d_1^2\Delta q_1$, which must equal the moment $T_1$ on axle 20. Therefore, $$2K_1 d_1^2 \Delta q_1 = T_1$$

or, $$\Delta q_1 = T_1/2K_1 d_1^2$$

Similarly, it may be shown that $$\Delta q_3 = T_2/2K_2 d_2^2$$

so that equations (13) and (14) become:

$$q_1 = q_2(1+1/k)+T_1/2K_1 d_1^2 \tag{15}$$

$$q_3 = q_2(1+1/k)+T_2/2K_2 d_2^2 \tag{16}$$

But the torques $T_1$ and $T_2$ are proportional to the yaw displacement $q_2$ of the truck frame (which may occur as a result of a disturbance of the truck) as can be seen from equations (11) and (12). Substitution yields $$q_1 = q_2(1+1/k-f_T ca\lambda/K_1 d_1^2 r_1) \tag{17}$$

$$q_3 = q_2(1-1/k+f_T cb\lambda/K_2 d_2^2 r_2) \tag{18}$$

Referring again to FIG. 2 and equations (3) and (4), it is seen that the net moment acting on leading truck 5 is $$M_L = F_1 a - F_2 b + (1+1/k)T_1 + (1-1/k)T_2 \tag{19}$$

Substituting into (19) from equations (9) to (12), (17) and (18), yields $$M_L = 2f_L\left\{ aq_2\left(1+\frac{1}{k}-\frac{f_T ca\lambda}{K_1 d_1^2 r_1}\right) - bq_2\left(1-\frac{1}{k}+\frac{f_T cb\lambda}{K_2 d_2^2 r^2}\right)\right\} - \frac{2f_T c\lambda a}{r_1}\left(1+\frac{1}{k}\right)q_2 + \frac{2f_T c\lambda b}{r_2}\left(1-\frac{1}{k}\right)q_2$$

Dividing the net amount $M_L$ on leading truck 5 by the angular displacement $q_2$ of truck 5 with respect to car body 10 gives the effective torsional stiffness $Q_L$ acting on leading truck 5 in a direction to increase angular displacement $q_2$ (i.e. non-restoring)

$$Q_L = 2f_L\left\{ -(b-a)+\frac{a+b}{k} - f_T c\lambda\left(\frac{b^2}{K_2 d_2^2 r_2} + \frac{a^2}{K_1 d_1^2 r_1}\right)\right\} + 2f_T c\lambda\left(\frac{b}{r_2}-\frac{a}{r_1}\right) - \frac{2f_T c\lambda}{k}\left(\frac{a}{r_1}+\frac{b}{r_2}\right) \tag{20}$$

As there are no other forces acting on leading truck 5 (other than those which may exist between the car body and truck), it will be stable if the right side of equation (20) is less than or equal to zero. Otherwise, once a disturbance has induced a yaw displacement $q_2$ of the truck frame, leading truck 5 may move so as to increase the displacement from the desired position until there is contact between rail 4 and the flange of a wheel 12. However, when the right side of equation (20) is positive, stability can still be ensured by providing pivotal connection 28 between truck 5 and car body 10 with an elastomeric restraint 32 or a torsional spring such as air bag suspension 33 having a torsional stiffness greater than or equal to the right side of equation (20). It is pointed out that when the right side of equation (20) is not positive, or alternately when pivotal connection 28 is provided with a suitable elastomeric restraint or torsional spring, truck 5 will be stable provided that it is the leading truck on railroad vehicle 2.

In equation (20), make the following substitutions:

$$a = A/2 - x$$

$$b=A/2+x$$

Here A is the wheel base of truck 5, so that x measures the amount of offset between pivotal vertical axis 30 and the point midway between axles 20, 22, the positive direction being toward outboard axle 20. Thus, equation (20) becomes $$Q_L = 2f_L\left\{\left(\frac{A}{k}-2x\right)-\frac{f_T c\lambda}{K_1 d_1^2 r_1}\left[\left(\frac{A}{2}-x\right)^2+\left(\frac{A}{2}+x\right)^2\frac{K_1 d_1^2 r_1}{K_2 d_2^2 r_2}+\frac{K_1 d_1^2 r_1}{f_L}\left(\left(\frac{A}{2}-x\right)\left(1+\frac{1}{k}\right)\frac{1}{r_1}-\left(\frac{A}{2}+x\right)\left(1-\frac{1}{k}\right)\frac{1}{r_2}\right)\right]\right\} \quad (21)$$

Truck 5 will be stable if the right side of equation (21) is less than or equal to zero, in the absence of any other forces acting on leading truck 5. Alternatively, if the right side of equation (21) is positive, truck 5 will be stable if an elastomeric restraint or torsional spring is provided to give a torsional stiffness $K_T$ of pivotal connection 28 which is greater than or equal to the right side of equation (21). That is, truck 5 will be stable as a leading truck provided that $$K_T \geqq 2f_L\left\{\left(\frac{A}{k}-2x\right)-\frac{f_T c\lambda}{K_1 d_1^2 r_1}\left[\left(\frac{A}{2}-x\right)^2+\left(\frac{A}{2}+x\right)^2\frac{K_1 d_1^2 r_1}{K_2 d_2^2 r_2}+\frac{K_1 d_1^2 r_1}{f_L}\left(\left(\frac{A}{2}-x\right)\left(1+\frac{1}{k}\right)\frac{1}{r_1}-\left(\frac{A}{2}+x\right)\left(1-\frac{1}{k}\right)\frac{1}{r_2}\right)\right]\right\} \quad (22)$$

Examining now the situation for a trailing truck, the effective torsional stiffness of the forces acting can be derived in a similar manner to the above and is:

$$Q_T = 2f_L\left\{-\left(\frac{A}{k}-2x\right)-\frac{f_T c\lambda}{K_1 d_1^2 r_1}\left[\left(\frac{A}{2}-x\right)^2+\left(\frac{A}{2}+x\right)^2\frac{K_1 d_1^2 r_1}{K_2 d_2^2 r_2}-\frac{K_1 d_1^2 r_1}{f_L}\left(\left(\frac{A}{2}-x\right)\left(1+\frac{1}{k}\right)\frac{1}{r_1}-\left(\frac{A}{2}+x\right)\left(1-\frac{1}{k}\right)\frac{1}{r_2}\right)\right]\right\} \quad (23)$$

Here x is again positive in the direction towards the outboard axle (in this case, the trailing axle) from the geometric truck centre. For stability of the trailing truck, the right side of equation (23) must be less than or equal to zero when there are no other forces acting on the truck. However, when an elastomeric restraint or torsional spring is provided so that the pivotal connection between the trailing truck and car body 10 has torsional stiffness $K_T$, the trailing truck will be stable if $$K_T \geqq 2f_L\left\{-\left(\frac{A}{k}-2x\right)-\frac{f_T c\lambda}{K_1 d_1^2 r_1}\left[\left(\frac{A}{2}-x\right)^2+\left(\frac{A}{2}+x\right)^2\frac{K_1 d_1^2 r_1}{K_2 d_2^2 r_2}-\frac{K_1 d_1^2 r_1}{f_L}\left(\left(\frac{A}{2}-x\right)\left(1+\frac{1}{k}\right)\frac{1}{r_1}-\left(\frac{A}{2}+x\right)\left(1-\frac{1}{k}\right)\frac{1}{r_2}\right)\right]\right\} \quad (24)$$

Therefore the truck will be stable as both a leading and as a trailing truck provided that the truck satisfies both expressions (22) and (24). Preferably therefore both leading and trailing trucks of railroad vehicle 2 will satisfy both expressions (22) and (24). In this case, the trucks of railroad vehicle 2 will be stable for either direction of motion of railroad vehicle 2. However, it will be appreciated that the parameters in expressions (22) and (24) for one truck need not necessarily have the same values as the corresponding parameters in these expressions for the other truck. Preferably, for convenience, railroad vehicle 2 will be provided with identical trucks, so that both trucks will have the same values for the parameters in expressions (22) and (24).

The above general expressions can be simplified for the more typical case of trucks in which the steering means stiffnesses and geometry and the wheel radii are the same for inboard and outboard axles. If we write:

$$K=K_1=K_2$$

$$d=d_1=d_2$$

$$r_0=r_1=r_2$$

we get, for the leading truck $$K_T \geqq 2f_L\left\{\left(\frac{A}{k}-2x\right)-\frac{f_T c\lambda}{Kd^2 r_0}\left[\left(\frac{A}{2}-x\right)^2+\left(\frac{A}{2}+x\right)^2+\frac{Kd^2}{f_L}\left(\frac{A}{k}-2x\right)\right]\right\}$$

and for the trailing truck $$K_T \geqq 2f_L\left\{-\left(\frac{A}{k}-2x\right)-\frac{f_T c\lambda}{Kd^2 r_0}\left[\left(\frac{A}{2}-x\right)^2+\left(\frac{A}{2}+x\right)^2-\frac{Kd^2}{f_L}\left(\frac{A}{k}-2x\right)\right]\right\}$$

In what follows, expressions are derived to ensure stability of a truck when used both as a leading and as a trailing truck. Accordingly, truck 5 may be a leading or a trailing truck, and it is assumed below that truck 5 always satisfies both expressions (22) and (24).

Consider first the case where the wheels 12 of truck 5 have no conicity, that is $\lambda=0$. The truck will be stable whether used as a trailing or as a leading truck provided that both expressions (22) and (24) hold with $\lambda$ set equal to zero. (Note that this is derived from the equations for the general case.) Therefore, $$K_T \geqq 2f_L(A/k-2x)$$

and $$K_T \geqq -2f_L(A/k-2x)$$

or combining the latter two expressions $$K_T \geqq 2f_L|A/k-2x| \tag{25}$$

When each wheel 12 has no conicity, a truck can still be stable as both a leading and as a trailing truck even without offsetting the pivotal vertical axis 30 (connecting the truck and the car body) from the geometric truck centre. Setting $\lambda=0$ and $x=0$ in both expressions (22) and (24) yields $$K_T \geqq 2f_L A/k \tag{26}$$

$$K_T \geqq -2f_L A/k$$

If expression (26) is satisfied, truck 5 will be stable both as a leading and as a trailing truck when the wheelset conicity is zero and the pivotal vertical axis 30 connecting truck 5 and car body 10 is not offset from the geometric truck centre.

Consider now the case when the pivotal connection 28 between truck 5 and car body 10 is not provided with an elastomeric restraint or torsional spring, that is when $K_T=0$. In this case, a truck will be stable both as a leading and as a trailing truck if the right sides of expressions (21) and (23) are not positive.

Suppose in addition that the wheelset conicity $\lambda=0$. Then a truck will be stable both as a leading and as a trailing truck, if in expressions (21) and (23), $$A/k-2x \leqq 0$$

and $$-(A/k-2x) \leqq 0$$

respectively. Therefore, $$x=A/2k \tag{27}$$

Suppose again that $K_T=0$, so that no elastomeric restraint or torsional spring is provided in pivotal connection 28 between truck 5 and car body 10. Assume in addition that the vertical axis 30 of pivotal connection 28 is not offset from the geometric truck centre, so that $x=0$. For the right sides of expressions (21) and (23) to be less than or equal to zero, then $$\frac{A}{k} - \frac{Af_T c\lambda}{2K_1d_1^2r_1}\left[\frac{A}{2}\left(1+\frac{K_1d_1^2r_1}{K_2d_2^2r_2}\right)+\frac{K_1d_1^2r_1}{f_L}\left(\frac{(k+1)}{kr_1}-\frac{(k-1)}{kr_2}\right)\right] \leqq 0 \tag{28}$$

and $$\frac{A}{k} + \frac{Af_T c\lambda}{2K_1d_1^2r_1}\left[\frac{A}{2}\left(1+\frac{K_1d_1^2r_1}{K_2d_2^2r_2}\right)-\frac{K_1d_1^2r_1}{f_L}\left(\frac{(k+1)}{kr_1}-\frac{(k-1)}{kr_2}\right)\right] \geqq 0 \tag{29}$$

Hence (from 28)

$$\frac{\lambda}{K_1d_1^2} \geqq \frac{2r_1}{kf_T c\left[\frac{A}{2}\left(1+\frac{K_1d_1^2r_1}{K_2d_2^2r_2}\right)+\frac{K_1d_1^2r_1}{f_L}\left(\frac{(k+1)}{kr_1}-\frac{(k-1)}{kr_2}\right)\right]}, \tag{30}$$

and (from 29)

$$\frac{\lambda}{K_1d_1^2} \leqq \frac{2r_1}{kf_T c\left[\frac{K_1d_1^2r_1}{f_L}\left(\frac{(k+1)}{kr_1}-\frac{(k-1)}{kr_2}\right)-\frac{A}{2}\left(1+\frac{K_1d_1^2r_1}{K_2d_2^2r_2}\right)\right]} \tag{31}$$

when $$\frac{K_1d_1^2r_1}{f_L}\left(\frac{(k+1)}{kr_1}-\frac{(k-1)}{kr_2}\right) > \frac{A}{2}\left(1+\frac{K_1d_1^2r_1}{K_2d_2^2r_2}\right) \tag{32}$$

Clearly (29) is satisfied if $$\frac{K_1d_1^2r_1}{f_L}\left(\frac{(k+1)}{kr_1}-\frac{(k-1)}{kr_2}\right) \leqq \frac{A}{2}\left(1+\frac{K_1d_1^2r_1}{K_2d_2^2r_2}\right) \tag{33}$$

Thus, when there is no elastomeric restraint or torsional spring provided in pivotal connection 28, and when the vertical axis 30 of pivotal connection 28 is not offset from the geometric truck centre, the truck will be stable both as a leading and as a trailing truck provided that expression (30) holds and in addition either expression (33) holds or expressions (31) and (32) are true.

Finally, consider the general case where the torsional stiffness $K_T$ is equal to zero in expressions (22) and (24). In this case, it follows immediately that $$\frac{f_{Tc}\lambda}{K_1d_1^2r_1}\left[\left(\frac{A}{2}-x\right)^2+\left(\frac{A}{2}+x\right)^2\frac{K_1d_1^2r_1}{K_2d_2^2r_2}\right]\geqq$$

$$\left(\frac{A}{k}-2x\right)-$$

$$\frac{f_{Tc}\lambda}{f_L}\left[\left(\frac{A}{2}-x\right)\frac{(k+1)}{kr_1}-\left(\frac{A}{2}+x\right)\frac{(k-1)}{kr_2}\right]$$

and $$\frac{f_{Tc}\lambda}{K_1d_1^2r_1}\left[\left(\frac{A}{2}-x\right)^2+\left(\frac{A}{2}+x\right)^2\frac{K_1d_1^2r_1}{K_2d_2^2r_2}\right]\geqq$$

$$-\left(\frac{A}{k}-2x\right)+$$

$$\frac{f_{Tc}\lambda}{f_L}\left[\left(\frac{A}{2}-x\right)\frac{(k+1)}{kr_1}-\left(\frac{A}{2}+x\right)\frac{(k-1)}{kr_2}\right]$$

For the case where all wheels on the truck have a common radius $r_0$ these simplify to $$\frac{f_{Tc}\lambda}{K_1d_1^2r_0}\left[\left(\frac{A}{2}-x\right)^2+\left(\frac{A}{2}+x\right)^2\frac{K_1d_1^2}{K_2d_2^2}\right]\geqq$$

$$\left(\frac{A}{k}-2x\right)\left(1-\frac{f_{Tc}\lambda}{f_Lr_0}\right)$$

and $$\frac{f_{Tc}\lambda}{K_1d_1^2r_0}\left[\left(\frac{A}{2}-x\right)^2+\left(\frac{A}{2}+x\right)^2\frac{K_1d_1^2}{K_2d_2^2}\right]\geqq$$

$$-\left(\frac{A}{k}-2x\right)\left(1-\frac{f_{Tc}\lambda}{f_Lr_0}\right)$$

which can be combined to give $$\frac{\lambda}{K_1d_1^2}\geqq\frac{\left|\left(\frac{A}{k}-2x\right)\left(\frac{r_0}{f_{Tc}}-\frac{\lambda}{f_L}\right)\right|}{\left[\left(\frac{A}{2}-x\right)^2+\left(\frac{A}{2}+x\right)^2\frac{K_1d_1^2}{K_2d_2^2}\right]} \tag{34}$$

and for the fully symmetric case in which $K_1=K_2=K$ and $d_1=d_2=d$ this further simplifies to:

$$\frac{\lambda}{Kd^2}\geqq\frac{\left|\left(\frac{A}{k}-2x\right)\left(\frac{r_0}{f_{Tc}}-\frac{\lambda}{f_L}\right)\right|}{\left[\left(\frac{A}{2}-x\right)^2+\left(\frac{A}{2}+x\right)^2\right]}$$

Therefore when there is no elastomeric restraint or torsional spring provided in pivotal connection 28, and all wheels on the truck have a common radius, the truck will be stable both as a leading and as a trailing truck provided that expression (34) holds.

Figure 7:
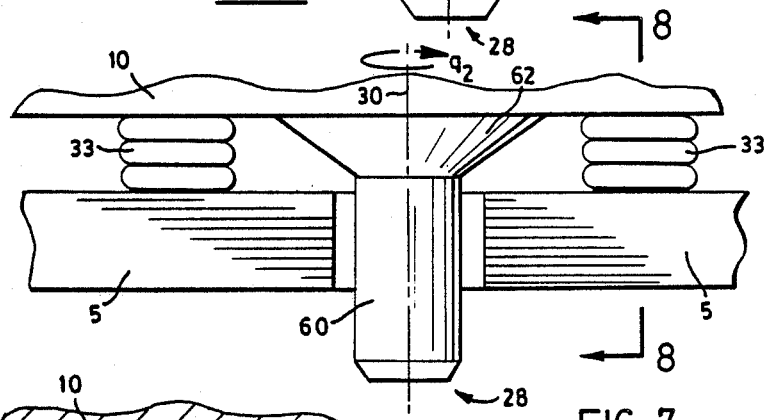
FIG. 7 illustrates a means of arranging for an air bag suspension having torsional stiffness between the car body and the truck frame.
Figure 8:
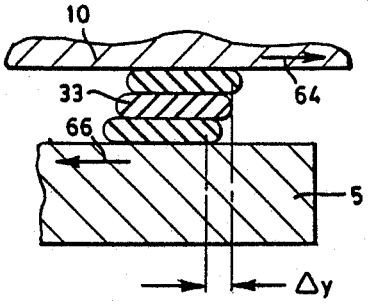
FIG. 8 is a sectional view taken in the direction of lines 8—8 of FIG. 7.

FIG. 6 and FIGS. 7 and 8 illustrate alternate arrangements of an elastomeric restraint or a torsional spring such as an air bag suspension between car body 10 and truck 5, in order to provide the torsional stiffness $K_T$. In FIGS. 6 and 7, pivotal connection 28 comprises a vertical axle 60 arranged in a conventional manner to pivot relative to truck 5 about vertical axis 30. Axle 60 is tapered outwardly to a greater diameter at 62 for rigid attachment to car body 10.

In FIG. 6, between truck 5 and the outwardly tapered portion 62, an elastomeric restraint 32 is provided to resist a shearing motion when car body 10 pivots relative to truck 5. Assume as above that the elastomeric restraint 32 has torsional stiffness $K_T$. If truck 5 rotates an angle $q_2$ relative to car body 10, the resistance to shear by elastomeric restraint 32 will result in a restoring moment equal to $K_T.q_2$.

In FIG. 7, the air bag suspension 33 is provided on each side of pivotal connection 28 between, and attaching to, each of car body 10 and truck 5. Air bag suspensions 33 are such as to resist shearing when truck 5 pivots relative to car body 10. If for example truck 5 pivots clockwise relative to car body 10, the ends of right air bag suspension 33 will be displaced in the direction of the horizontal arrows 64, 66 in the sectional view of FIG. 8, for a horizontal displacement $\Delta y$ between the ends of air bag suspension 33. Suppose that the torsional stiffness due to air bag suspensions 33 is $K_T$. Then if $q_2$ is the angular displacement of truck 5 relative to car body 10, the restoring moment due to air bag suspensions 33 will be $K_T.q_2$.

Accordingly, the result of the arrangement in FIG. 6, or alternatively in FIGS. 7 and 8, is to provide pivotal connection 28 with a torsional stiffness $K_T$. It will be appreciated that by suitable choice of the elastomeric restraint or torsional springs, the torsional stiffness $K_T$ can be selected appropriately as set out above so that the truck is stable.

Figure 9:
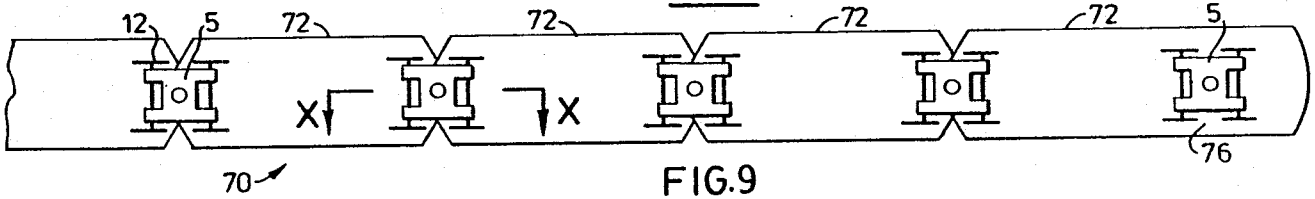
FIG. 9 illustrates schematically in plan a portion of an articulated vehicle having a plurality of trucks according to the invention.
Figure 10:
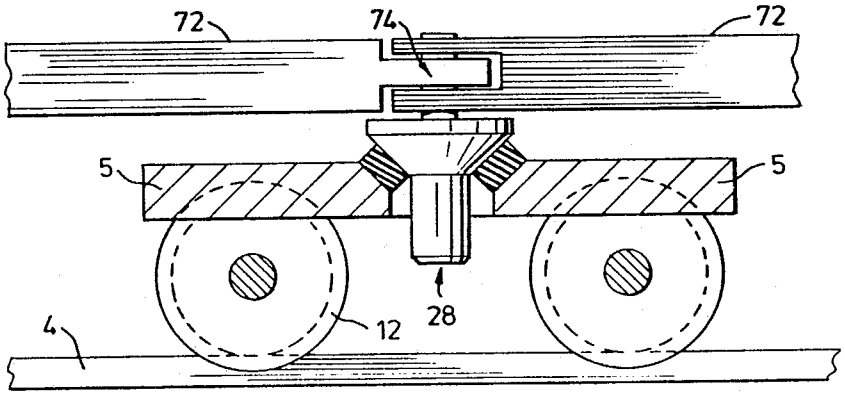
FIG. 10 is a sectional view taken in the direction of lines X—X of FIG. 9.

It is pointed out that the invention includes railroad vehicles of the type known as articulated vehicles, as shown in plan view in FIG. 9. Articulated vehicle 70 comprises a plurality of body portions 72 joined together by articulated joints 74, illustrated most clearly in FIG. 10. Articulated vehicle 70 is supported at the outboard portions 76 thereof by steerable trucks 5 of the type described above. Similarly each articulated joint 74 is supported by a steerable truck 5 of the type described above.

Each of the two outboard trucks 5 has a pivotal connection between the truck and the respective outboard portion 76. Each of the remaining trucks 5 has a pivotal connection 28 between the truck and the respective articulated joint 74. Each of the trucks 5 contain steering means whereby the axles of trucks 5 are moved to the radial position when articulated vehicle 70 is travelling on curved track. The alignment of the axles of each truck 5 is obtained in response to the angle to which that truck pivots relative to a respective body portion 72 in traversing the curved track. The ratio of this angle and the resultant angle to which each axle of the respective truck 5 pivots relative to that truck defines a steering ratio k for each steering means. This ratio is common for the two axles of the respective truck 5. The leading outboard truck 5 will be stable provided that expression (22) is satisfied, and the trailing outboard truck 5 will be stable provided that expression (24) is satisfied as was set out above. Each remaining truck 5 is stable provided that it satisfies expression (22) or (24) respectively depending on whether it is designed as a steerable leading truck of the respective trailing body portion or as a steerable trailing truck of the respective leading body portion. The remainder of the mathematical relationships set out above which provide for stability when satisfied also apply to the articulated vehicle.

It should be noted that in FIG. 1, the left truck is shown provided with an elastomeric restraint between truck 5 and car body 10, while the right truck is shown provided with alternate air bag suspensions between truck 5 and car body 10. However, it will be appreciated that both trucks may be provided with identical elastomeric restraints or torsional springs, or otherwise arranged to have torsional stiffness between the truck 5 and car body 10.

Finally, it will be understood that the particular arrangements shown here for providing a torsional stiffness $K_T$ in the pivotal connection between the truck and car body are not central to the invention. Various other arrangements may be used to provide a torsional stiffness $K_T$ of an appropriate value as set out above so that the truck is stable.

We claim:

1. A railroad vehicle for movement on a railroad track comprising:

a body having a longitudinal axis;

a truck having a longitudinal axis;

outboard and inboard axles connected to said truck for pivotal movement about respective vertical axes;

a pair of wheels supported by each of said axle for rotation therewith, each said pair of wheels being disposed for operative engagement with said track and for bearing substantially the same load as said other pair of wheels;

steering means operatively interconnecting said axles, truck and body for radially aligning said axles when said truck is on a curved track in response to the angle between the longitudinal axes of said body and said truck; and means connecting said truck to said body for pivotal movement about a vertical axis on the longitudinal axis of said truck, said vertical axis being offset towards said outboard axle a predetermined distance from the midpoint between said axles to generate a moment about said vertical axis tending to resist deviation of said truck from a generally parallel relationship between the longitudinal axis of said truck and a straight track and a generally tangential relationship between the longitudinal axis of said truck and a curved track.

2. The railroad vehicle of claim 1 wherein said predetermined distance is selected to satisfy the relationship:

$$\frac{\lambda}{K_1 d_1^2} \quad \frac{\left|\left(\frac{A}{k} - 2x\right)\left(\frac{r}{f_T c} - \frac{\lambda}{f_L}\right)\right|}{\left[\left(\frac{A}{2} - x\right)^2 + \left(\frac{A}{2} + x\right)^2 \frac{K_1 d_1^2}{K_2 d_2^2}\right]}$$

wherein:

$f_L$ is the lateral creep coefficient;

$f_T$ is the longitudinal creep coefficient;

k is the steering ratio of said steering means;

$d_1$ and $d_2$ are the distances from the longitudinal axis of said truck at which said steering means acts on said outboard and inboard axles, respectively;

$K_1$ and $K_2$ are the stiffness of the steering means acting on the outboard and inboard axles, respectively;

λ is the average conicity of said wheels;

r is the radius of said wheels;

c is one-half the gauge of said track;

A is the longitudinal distance between said axles; and x is said predetermined distance.

3. The railroad vehicle of claim 1 also including means resiliently interconnecting said truck and said body for resisting relative angular movement with torsional stiffness $K_T$ satisfying at least one of the relationships:

$$K_T \quad 2f_L\left\{\left(\frac{A}{k} - 2x\right) - \frac{f_T c\lambda}{K_1 d_1^2 r_1}\left[\left(\frac{A}{2} - x\right)^2 + \left(\frac{A}{2} + x\right)^2 \frac{K_1 d_1^2 r_1}{K_2 d_2^2 r_2} + \frac{K_1 d_1^2 r_1}{f_L}\left(\left(\frac{A}{2} - x\right)\frac{(k+1)}{kr_1} - \left(\frac{A}{2} + x\right)\frac{(k-1)}{kr_2}\right)\right]\right\} \tag{a}$$

and $$K_T \quad 2f_L\left\{-\left(\frac{A}{k} - 2x\right) - \frac{f_T c\lambda}{K_1 d_1^2 r_1}\left[\left(\frac{A}{2} - x\right)^2 + \left(\frac{A}{2} + x\right)^2 \frac{K_1 d_1^2 r_1}{K_2 d_2^2 r_2} - \frac{K_1 d_1^2 r_1}{f_L}\left(\left(\frac{A}{2} - x\right)\frac{(k+1)}{kr_1} - \left(\frac{A}{2} + x\right)\frac{(k-1)}{kr_2}\right)\right]\right\} \tag{b}$$

wherein $f_L$ is the lateral creep coefficient;

$f_T$ is the longitudinal creep coefficient;

k is the steering ratio of said steering means;

$d_1$ and $d_2$ are the distances from the longitudinal axis of said truck at which said steering means acts on said outboard and inboard axles, respectively;

$K_1$ and $K_2$ are the stiffness of the steering means acting on the outboard and inboard axles, respectively;

λ is the average conicity of said wheels;

r is the radius of said wheels;

c is one-half the gauge of said track;

A is the longitudinal distance between said axles; and x is said predetermined distance.

4. A railroad vehicle for movement on a railroad track comprising:

a pair of bodies each having a longitudinal axis, said bodies being coaxially interconnected by an articulated coupling;

a truck having a longitudinal axis;

first and second axles connected to said truck for pivotal movement about respective vertical axes;

a pair of wheels supported by each said axle for rotation therewith, each said pair of wheels being disposed for operative engagement with said track and for bearing substantially the same load as said other pair of wheels;

steering means operatively interconnecting said axles, truck and at least one said body for radially aligning said axles when said truck is on a curved track in response to the angle between the longitudinal axes of said body and said truck; and means connecting said truck to said coupling for pivotal movement about a vertical axis on the longitudinal axis of said truck, said vertical axis being offset toward one said axle a predetermined distance from the midpoint between said axles to generate a moment about said vertical axis tending to resist deviation of said truck from a generally parallel relationship between the longitudinal axis of said truck and a straight track and a generally tangential relationship between the longitudinal axis of said truck and a curved track.

* * * * *

UNITED STATES PATENT AND TRADEMARK OFFICE

CERTIFICATE OF CORRECTION

PATENT NO. : 4,819,566

DATED : April 11, 1989

INVENTOR(S) : Roy E. Smith and Ron J. Anderson

It is certified that error appears in the above-identified patent and that said Letters Patent is hereby corrected as shown below:

Claim 2, line 3, after " $\frac{\lambda}{K_1 d_1^2}$ ", insert -- $\bar{>}$ --.

Claim 3, line 6, after "$K_T$" insert -- $\bar{>}$ --.

Claim 3, line 19, after "$K_T$" insert -- $\bar{>}$ --.

Signed and Sealed this

Ninth Day of January, 1990

*Attest:*

JEFFREY M. SAMUELS

*Attesting Officer* *Acting Commissioner of Patents and Trademarks*